US007288051B1

(12) United States Patent
Phillips

(10) Patent No.: US 7,288,051 B1
(45) Date of Patent: Oct. 30, 2007

(54) EXERCISE HANDLE

(76) Inventor: Susan G. Phillips, 6125 E. Ocean Blvd., #202, Long Beach, CA (US) 90803

( * ) Notice: Subject to any disclaimer, the term of this patent is extended or adjusted under 35 U.S.C. 154(b) by 25 days.

(21) Appl. No.: 10/377,437

(22) Filed: Feb. 28, 2003

(51) Int. Cl.
*A63B 21/02* (2006.01)
*A63B 23/14* (2006.01)
*A63B 23/16* (2006.01)

(52) U.S. Cl. ..... 482/124; 482/45; 482/47

(58) Field of Classification Search ..... 482/44, 482/47–49, 121–126, 45
See application file for complete search history.

(56) References Cited

U.S. PATENT DOCUMENTS 2,222,180 A * 11/1940 Marsh ..... 84/468
4,730,827 A * 3/1988 Williams ..... 482/47
5,013,030 A * 5/1991 Frins ..... 482/47
5,058,885 A * 10/1991 Brant ..... 482/48
5,062,625 A * 11/1991 Vonk ..... 482/48
5,135,217 A * 8/1992 Swain ..... 473/450
5,613,923 A * 3/1997 Anliker ..... 482/48
6,110,075 A * 8/2000 Woodruff ..... 482/47
6,179,751 B1 * 1/2001 Clears ..... 482/48
6,228,001 B1 * 5/2001 Johnson et al. ..... 482/48

* cited by examiner

*Primary Examiner*—Fenn C. Mathew
(74) *Attorney, Agent, or Firm*—Kenneth L. Green; Edgar W. Averill, Jr.

(57) ABSTRACT

An exercise handle is made up of a hand tension grip made of an elastomeric material with multiple finger openings and a connection device. The hand tension grip allows for full extension of fingers placed in its finger openings during closed kinetic chain exercises. The connection device is connected to the hand tension grip so that extension of fingers placed in its finger openings will cause the hand tension grip to stretch between the connection device and the finger openings, and the connection device is positioned so that it will be distant to the hand and proximate to a radius bone of the person using the handle.

18 Claims, 4 Drawing Sheets

EXERCISE HANDLE

FIELD OF THE INVENTION

The present invention is in the field of exercise devices, and more particularly, to a handle for use with exercise devices that allows for full extension of the fingers during exercise.

BACKGROUND OF THE INVENTION

Over the years our society has created many overuse problems of various muscles that lead to pain, dysfunction, lack of movement, and costly medical procedures.

Our society has also developed, and pursued, a variety of different exercise programs, using many different exercise devices, to exercise many different types of muscles. For example, there are a variety of exercises that can be performed with different handles using weights, bands and other devices.

However, despite all of the attention, time and money spent on exercise and various different exercise programs and regimens, using many different devices, there has been a general lack of stimulation of the extensor muscles of the fingers in closed kinetic chain exercises. Indeed, current handles on exercise devices universally require fingers to maintain a flexed position during extension exercises.

The present invention recognizes that there is a long-felt problem that heretofore has gone unrecognized—lack of extension stimulation of fingers during closed kinetic chain exercises—and provides a device and method for providing extension stimulation of fingers. The result is that many different problems that formerly went unrecognized or untreated can now be treated through use of an inexpensive, simple exercise handle.

SUMMARY OF THE INVENTION

The present invention is generally directed to an exercise handle that has a hand tension grip made of an elastomeric material with multiple finger openings (such as a thumb opening and one to four more additional finger openings) and a connection device connected to it distant from the finger openings toward the radius bone of a person using the handle. The exercise handle can be connected to another device (such as an exercise band) by the connection device, or it can be made integral with another device, and the connection device can also be made integral with the hand tension grip. The hand tension grip allows for full extension of fingers placed in its finger openings during an extension exercise and provides tension between the connection device and the finger openings due to an elastomeric quality of the hand tension grip.

In a first, separate group of aspects of the present invention, the connection device is connected to the hand tension grip so that extension of fingers placed in its finger openings will cause the hand tension grip to stretch between the connection device and the finger openings, and the connection device is positioned so that it will be distant to the wrist and proximate to a radius bone of the person using the handle.

In other, separate aspects of the present invention, the hand tension grip has an elastomeric quality between the connection device and the finger openings that will cause its deformation during exercise, but the hand tension grip will return to a non-deformation state when the hand is not fully extended.

In still other, separate aspects of the present invention, muscles in fingers of a hand of a person are exercised by inserting the fingers into finger openings of an exercise handle having a hand tension grip with an elastomeric quality, then extending the arm, and then extending the fingers so that the hand is fully extended and the hand tension grip is at least partially deformed.

Accordingly, it is a primary object of the present invention to provide an improved exercise handle that can be used to exercise finger muscles during closed kinetic chain exercises.

This and further objects and advantages will be apparent to those skilled in the art in connection with the drawings and the detailed description of the preferred embodiment set forth below.

DETAILED DESCRIPTION OF THE PREFERRED EMBODIMENT

In accordance with a preferred embodiment of the present invention, an exercise handle is provided that can be used in any exercise that one desires full extension of the hand during closed kinetic chain exercises. The exercise handle of the present invention is designed to allow fingers to go from flexion to extension, from probation to supination, wherein supination is generally described as turning the palm forward or upward, and is described in Webster's New World Medical Dictionary as "rotation of the forearm and hand so that the palm is up". The exercise handle can fit onto many different modalities from bands to springs. Using the concept of closed kinetic chain exercise, this handle truly allows for a closed kinetic chain stimulation of the extensors of the upper body to begin at the fingers. It also allows for active stretching at the same time of the fingers. This is especially significant for a person who needs to or desires to work the whole arm in extension (i.e., for exercises that help to counteract overuse of the finger and hand flexors). This allows for strengthening the full arm extensors and finger extensors at once while stretching the opposing flexors of the arms in the fingers at the same time.

Figure 1A:
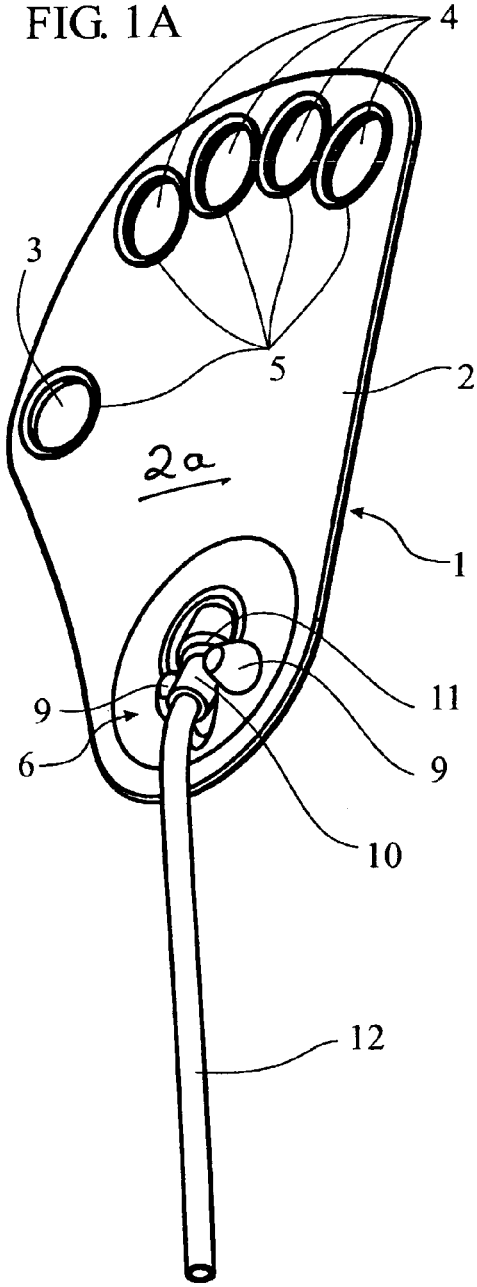
FIGS. 1A and 1B show a front and back view of an exercise handle according to the present invention connected to a band or cord.
Figure 1B:
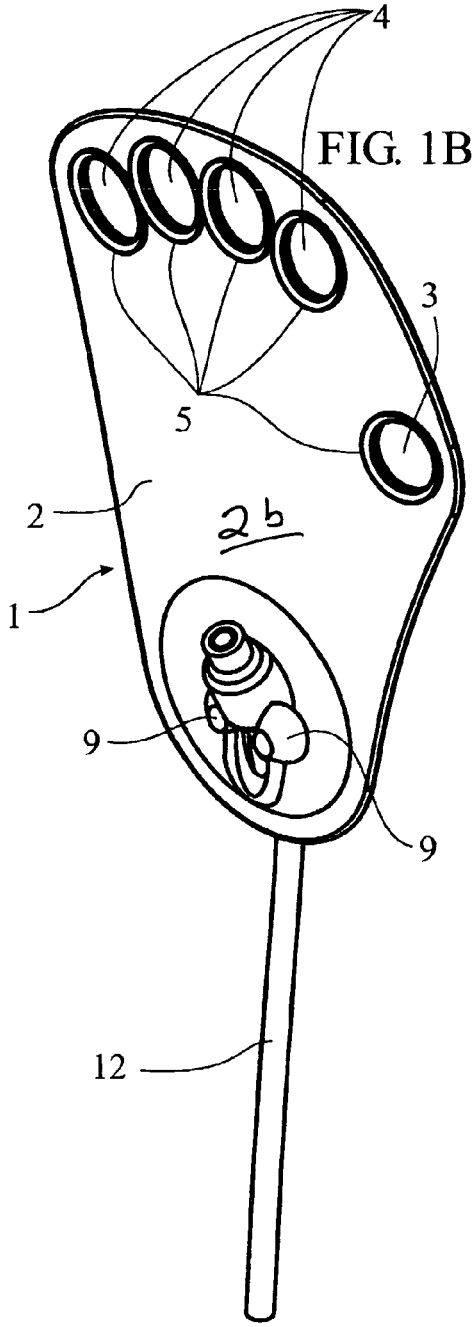

Referring now to FIGS. 1A and 1B, an exercise handle, generally designated as 1, is connected to an exercise band 12 by a connection device, generally designated as 6. Although exercise band 12 is shown as being separate from exercise handle 1, the two could be formed integrally with one another. In addition, something other than an exercise band could be connected to, or formed integral with, exercise handle 1. The front 2*a* and back 2*b* of the exercise handle 1 are seen to comprise entirely protrusionless (i.e., lacking protrusions) surfaces between the holes 3 and 4 and the connection device 6.

Exercise handle 1 has a hand tension grip 2 that has a thumb opening 3 and finger openings 4. Both the thumb opening 3 and the finger openings 4 have a finger ring 5 integrally formed with the hand tension grip 2, and elasticity of hand tension grip 2 and/or finger rings 5 allows for full extension of the fingers. Finger rings 5 help prevent wear and tear of elastomeric material used in hand tension grip 2, and can provide a rigid and wider surface for contact with either a thumb or another finger. The finger rings 5 formed around adjacent finger openings 4 are seen to be touching to provide closely spaced apart finger openings 4.

Figure 2:
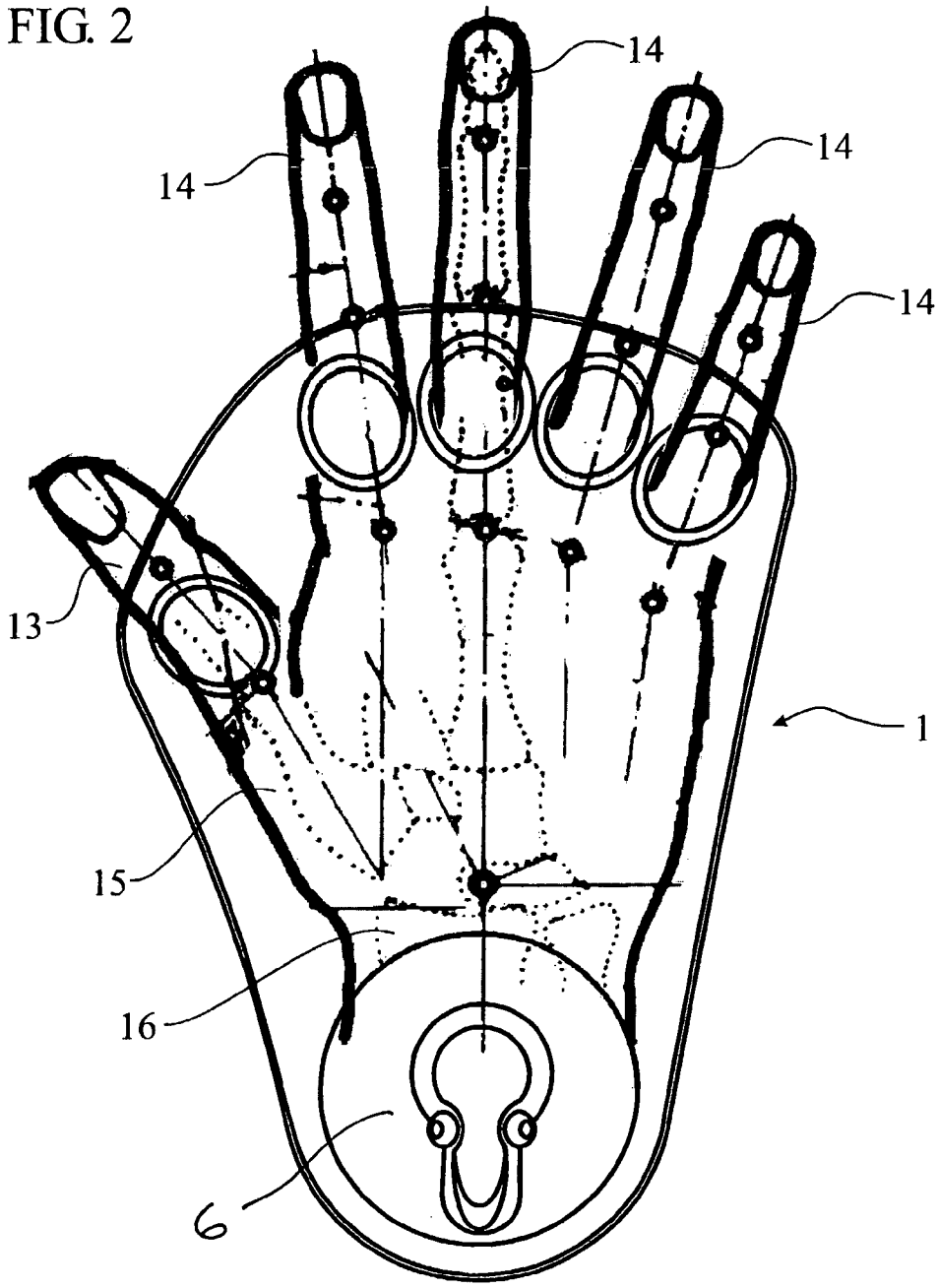
FIG. 2 shows a front view of an exercise handle with a hand inserted into it with a human factors overlay showing the relationship of an attachment point to a user's wrist.
Figure 3:
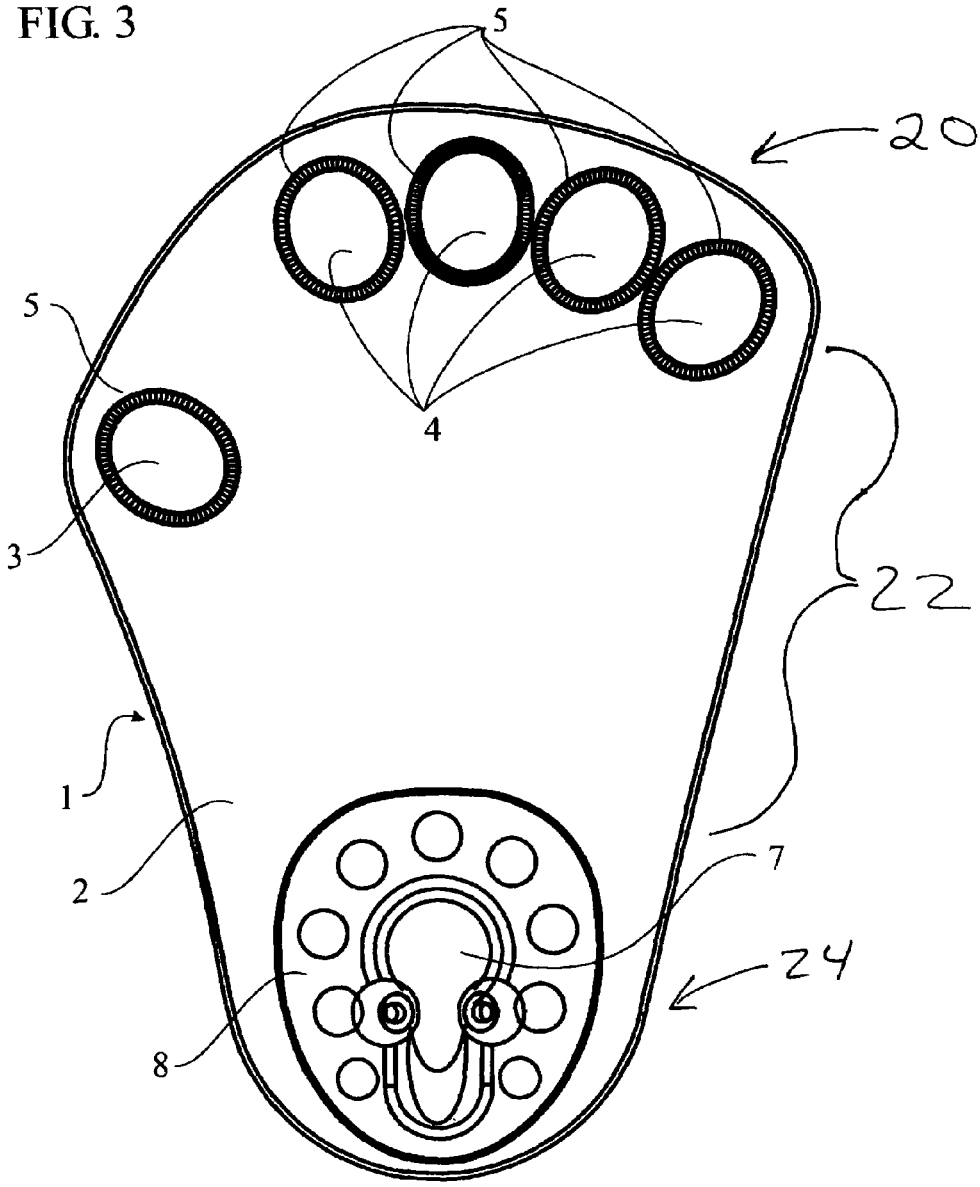
FIG. 3 is a front cutaway view of an exercise handle showing a molded in plastic reinforcement.
Figure 4:
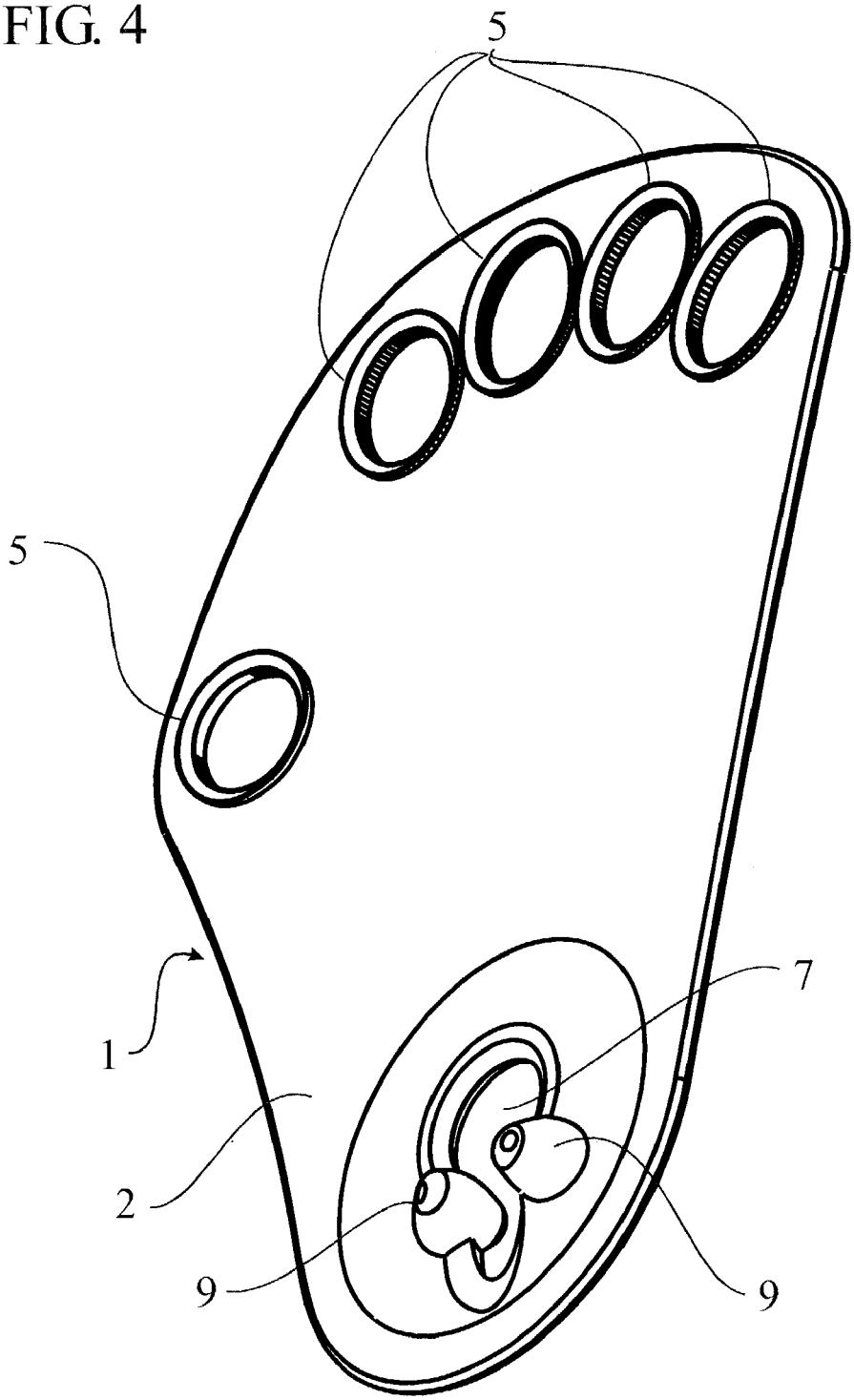
FIG. 4 is a perspective view of an exercise handle according to the present invention.

"FIG. 2 shows a front view of a hand 15 with fingers 14 inserted through the finger openings 4 and thumb 13 inserted through the thumb opening 3 of the exercise handle 1, and FIG. 3 shows a front view of the exercise handle 1 alone. The exercise handle 1 includes a grip body having an upper arcuate end 20, a center portion 22, and a lower connector end 24. The four finger openings 4 reside closely spaced apart and adjacent to the upper arcuate end 20 following a similar arc as the upper arcuate end 20. The thumb opening 3 resides to one side and below the four finger openings 4. As seen in FIG. 2, the placement of the finger openings 4 and the thumb opening 3 allows the fingers 14 to reside through the finger openings 4 and the thumb 13 to simultaneous reside through the thumb opening 3. Also, as seen in FIG. 2, the finger openings 4 and the thumb opening 3 are positioned on the exercise handle 1 so that while the fingers 14 reside through the finger openings 4 and the thumb 13 resides through the thumb opening 3, the connection device 6 resides at the connector end 24 just below the wrist and proximate to a radius bone of a person using the handle. The center portion 22 is continuous (i.e., uninterrupted in space, having no gaps or breaks) between the finger and thumb openings 3 and 4, and the connector 6." The arcuate end 20 is a free floating end having no attachment other than to the center portion 22.

Connection device 6 can take on any number of different forms or shapes, and actual selection of a suitable connection device is simply a matter of designer choice. As shown in FIGS. 1-4, connection device 6 has taken the form of a connection opening 7, which is shown as being shaped similarly to a keyhole, which basically functions as a female connector. The connection opening 7 is formed in a plastic reinforcement piece 8 (best shown in FIG. 3) that can be molded into hand tension grip 2. As shown in FIGS. 1A and 1B, connection device 6 can have lugs 9 that help to secure a shoulder 11 of male connector 10, which is shown in FIGS. 1A and 1B, as being connected to an exercise band 12.

Connection device 6 is located distant from the thumb and finger openings 3 and 4 toward the radius bone 16 of a person using the handle. The wrist is formed where the distal aspect of the radius and the triangular fibrocartilage of the ulna joins three of the four proximal carpal bones, and by positioning connection device 6 so that it will be distant to the hand, just below the wrist and proximate to a radius bone of a person using the handle, use of the handle 1 allows for more of an active stretch, as opposed to a passive stretch, when in use. (In FIG. 2, a rough outline of several bones of the hand 15 and the radius bone 16 are shown in phantom.) FIG. 2 also shows the grip (or grip body) 2 as having a paddle like shape outlining the palm and wrist. The paddle like shape contains the finger openings 4, the thumb opening 3, and the connector 6 (see FIG. 3). Portions of the grip body 2 reside between the finger and thumb opening 4, 3 and the connector 6, and between adjacent finger openings 4 and thumb opening 3.

Hand tension grip 2 has an elastomeric quality which can be obtained by making it of an elastomeric material. Because of this elastomeric quality, hand tension grip 2 will stretch (i.e., to deform from a resting or non-deformation state) and provide tension between connection device 6 and thumb and finger openings 3 and 4 when there is full extension of thumb 13 and fingers 14 placed in thumb and finger openings 3 and 4 during an extension exercise. The amount of elasticity of hand tension grip 2 can be varied and controlled so as to have different levels for different levels of activity, such as for intermediate or advanced exercise. This can be achieved through any of various different means, such as through use of different thicknesses of material for hand tension grip 2, or making hand tension grip 2 out of elastomeric materials having different durometer hardnesses, or through the use of ribbing, or a combination of the above, all of which is a matter of designer choice. Indeed, while hand tension grip 2 is shown as being solid in FIGS. 1A-4, it need not be, and its shape can be varied according to designer choice so as to accomplish the functional purposes stated herein. Also, as part of such designer choice, hand tension grip 2 may be perforated or made of varying materials or composite parts.

Exercise handle 1 will exercise muscles in fingers of a hand when the fingers are inserted into its finger openings, the arm is extended and the fingers are extended so that the hand is fully extended and the hand tension grip is at least partially deformed. Exercise handle 1 can be used for different exercises, depending upon whether the front or the back of the hand is proximate to hand tension grip 2. (FIG. 2 shows the back of hand 15 being proximate to hand tension grip 2.)

While the invention has been described herein with reference to certain preferred embodiments, those embodiments have been presented by way of example only, and not to limit the scope of the invention. Additional embodiments thereof will be obvious to those skilled in the art having the benefit of this detailed description. Further modifications are also possible in alternative embodiments without departing from the inventive concept.

Accordingly, it will be apparent to those skilled in the art that still further changes and modifications in the actual concepts described herein can readily be made without departing from the spirit and scope of the disclosed inventions as defined by the following claims.

What is claimed is:

1. An exercise device, comprising:

a resistance device having a first end and a second end;

an elastic grip body including:

an upper arcuate end;

a single row of finger openings forming an arc adjacent to the upper arcuate end;

a thumb opening spaced below and to the side of the finger openings;

a connector end opposite the arcuate end and positioned with respect to the finger openings and the thumb opening so that while fingers are inserted into the finger openings and a thumb is inserted into the thumb opening, the connector end resides below a wrist and proximal to a radius bone of the person using the exercise device;

a center portion extending continuously between the finger and thumb openings and the connector end;

a back, the back entirely protrusionless between the finger and thumb openings and the connector end; and a front, the front is entirely protrusionless between the finger and thumb openings and the connector end;

a connection device attached to the grip body at the connector end and connectable to the first end of the resistance device, wherein the grip body allows for extension of fingers placed in the plurality of openings during a closed kinetic chain exercise and provides tension between the connection device and the openings due to an elastomeric quality of the grip body so that extensors of an upper body are exercised when the exercise device is used in the closed kinetic chain exercise, and wherein all connections between the resistance device and the grip body are distant from the openings toward the radius bone.

2. The exercise device of claim 1, wherein the finger openings are closely laterally spaced allowing the fingers to be fully insertable through the openings.

3. The exercise device of claim 2 wherein the thumb opening is laterally spaced apart from the finger openings allowing the thumb and the fingers to be fully insertable through the thumb and finger openings respectively.

4. The exercise device of claim 2, wherein the finger openings reside on a first arc allowing the fingers to be fully insertable through the openings and the thumb opening resides closer to the connection device than the finger openings to allow the thumb to be fully insertable through the thumb opening, thereby distributing a load to all of the fingers and to the thumb.

5. The exercise device of claim 1, wherein the connection device is connected to the grip body so that extension of the fingers placed in the finger openings will cause the grip body to stretch between the connection device and the plurality of openings.

6. The exercise device of claim 1, wherein the arcuate end is free floating.

7. The exercise device of claim 1, wherein the connection device is integral with the resistance device.

8. An exercise device useful in an exercise in which it is desirable to achieve full extension of a hand, the exercise device comprising:

a resistance device having a first end and a second end;

a grip body comprising:

an upper arcuate end;

a single set of four closely spaced apart finger openings forming an arc adjacent to the upper arcuate end and configured to allow fingers to be fully insertable through the finger openings;

a connector end opposite the upper arcuate end, the grip body configured to distally space the connector end apart from the finger openings towards the radius bone of a person using the grip body;

a center portion extending continuously between the finger openings and the connector end;

a back, the back entirely protrusionless between the finger and thumb openings and the connector end; and a front, the front is entirely protrusionless between the finger and thumb openings and the connector end;

a connection device attached to the grip body at the connector end and positioned with respect to the four finger openings so that when the fingers are fully inserted into the four finger openings, the connection device is below a wrist and proximal to a radius bone of the person using the exercise handle, the connection device connectable to the first end of the resistance device;

wherein the grip body allows for extension of fingers placed in the finger openings during a closed kinetic chain exercise and provides tension between the connection device and the four finger openings due to an elastomeric quality of the grip body so that extensors of an upper body are exercised when the exercise device is used in the closed kinetic chain exercise, and wherein all connections between the resistance device and the grip body are distant from the openings toward the radius bone.

9. The exercise device of claim 8, wherein the elastomeric quality causes deformation of the grip body during the exercise and the grip body will return to a non-deformation state when the hand is not fully extended.

10. The exercise device of claim 8 further including a thumb opening spaced laterally apart from the four finger openings and closer to the-connector end than the four finger openings so that the fingers and thumb may be fully inserted into the finger holes and the thumb hole.

11. The exercise device of claim 8, wherein the connection device is connected to the grip body so that extension of the hand while its fingers are placed in the plurality of finger openings during the exercise will cause the grip body to stretch.

12. A method of exercising extensors of an upper body through use of an exercise device which allows for extension of a plurality of fingers of a hand of a person during a closed kinetic chain exercise, comprising the steps of:

inserting the plurality of fingers into a plurality of finger openings from the bottom of a grip body, the plurality of finger openings adjacent to an arcuate end of the grip body of the exercise device, which arcuate end is opposite to a connector end, the grip body configured to distally space the connector end apart from the finger openings towards the radius bone of a person using the exercise device wherein the grip body has an elastomeric quality;

connecting a first end of a resistance device having the first end and a second end to a connection device attached to the connector end of the grip body;

extending an arm having the hand; and extending the fingers to supination so that the hand is fully extended and the grip body is at least partially deformed during the closed kinetic chain exercise.

13. The method of claim 12, wherein extending the fingers comprises extending the fingers in the finger openings having finger rings to help prevent tear of the grip.

14. The method of claim 12, wherein extending the fingers to supination comprises extending the fingers from pronation to supination.

15. The method of claim 12, wherein extending the fingers to supination comprises extending the fingers from flexion to extension and from pronation to supination.

16. The method of claim 12, wherein inserting the plurality of fingers into a plurality of finger openings from the bottom of a grip body, the plurality of finger openings adjacent to an arcuate end of the grip body of the exercise device, which arcuate end is opposite to a connector end, the grip body configured to distally space the connector end apart from the finger openings towards the radius bone of a person using the exercise device, comprises inserting the plurality of fingers into a plurality of finger openings from the bottom of a grip body, the plurality of finger openings adjacent to an arcuate end of the grip body of the exercise device, which arcuate end is opposite to a connector end, the grip body configured to distally space the connector end apart from the finger openings below a wrist and proximal to a radius bone of the person using the exercise device.

17. The exercise device of claim 8, wherein the arcuate end is free floating.

18. The exercise device of claim 8, further including finger rings around the finger openings for preventing damage to the grip body, the finger rings touching to provide closely spaced apart finger openings.

* * * * *